US006759958B2

(12) United States Patent
Hall

(10) Patent No.: US 6,759,958 B2
(45) Date of Patent: Jul. 6, 2004

(54) METHOD AND APPARATUS FOR LOCATING AN OBJECT

(76) Inventor: Philip R. Hall, 3805 Fretz Valley Rd., Ottsville, PA (US) 18942

( * ) Notice: Subject to any disclaimer, the term of this patent is extended or adjusted under 35 U.S.C. 154(b) by 0 days.

(21) Appl. No.: 10/374,315

(22) Filed: Feb. 26, 2003

(65) Prior Publication Data

US 2003/0164772 A1 Sep. 4, 2003

Related U.S. Application Data

(60) Provisional application No. 60/361,221, filed on Mar. 1, 2002.

(51) Int. Cl.[7] ..... G08B 13/14

(52) U.S. Cl. ..... 340/568.1; 340/571; 340/522; 340/683; 340/539.32; 340/600; 340/555; 340/521

(58) Field of Search ..... 340/568.1, 571, 340/522, 683, 539.32, 600, 555, 521

(56) References Cited

U.S. PATENT DOCUMENTS 4,460,892 A 7/1984 Bailey, Jr.
4,476,469 A * 10/1984 Lander ..... 340/825.49
4,507,653 A * 3/1985 Bayer ..... 340/539.32
5,648,757 A 7/1997 Vernace et al.
5,673,023 A 9/1997 Smith
5,677,675 A 10/1997 Taylor et al.
5,686,887 A 11/1997 Chen et al.
6,012,029 A 1/2000 Cirino et al.
6,501,378 B1 12/2002 Knaven
6,570,504 B2 * 5/2003 Rabanne et al. ..... 340/573.4
2003/0001738 A1 1/2003 Chandar

* cited by examiner

*Primary Examiner*—Daniel J. Wu
*Assistant Examiner*—Tai T. Nguyen
(74) *Attorney, Agent, or Firm*—Akin Gump Strauss Hauer & Feld, L.L.P.

(57) ABSTRACT

A method and apparatus for locating an object. In one embodiment, the occurrence of a plurality of transitions between a first light level and a second light level is detected. If a time period between at least some of the transitions is determined to be less than a predetermined value, an alert signal is emitted. In another embodiment, the alert signal is emitted if an ambient light level is detected to be below a predetermined threshold and the object is detected to not be in a predetermined axial orientation.

26 Claims, 3 Drawing Sheets

METHOD AND APPARATUS FOR LOCATING AN OBJECT

CROSS-REFERENCE TO RELATED APPLICATIONS

This application claims the benefit of U.S. Provisional Application No. 60/361,221, filed Mar. 1, 2002, entitled "Self-Locating Universal Remote Control," which is incorporated herein by reference in its entirety.

BACKGROUND OF THE INVENTION

Portable objects, such as remote transmitters used to control appliances (e.g., televisions, video recorder and stereo equipment), cellular phones, hand-held computers, pagers and car keys are often misplaced. For example, a remote transmitter may be lost in a room that the appliance it controls is located. The remote transmitter may easily fall behind a cushion of a sofa or chair, under a bed, or on top of a dresser, making the transmitter difficult to find.

One conventional method of preventing the loss of a portable electronic device is to secure the device in a holder and/or to an elastic band permanently mounted to a fixed structure, such as an end table near a bed in a motel or hotel room. This method is often used as an attempt to prevent theft or misplacement of the device, but is inconvenient to a user who desires the flexibility to remotely control an appliance from any various locations.

Another conventional method of preventing the loss of a portable electronic device is to incorporate an audible detector into the device that activates in response to a predetermined sequence of sound signals, such as those generated by hand claps, see, for example, U.S. Pat. No. 5,677,675 (Taylor et al.); a voice command included in a radio frequency carrier signal, see, for example, U.S. Pat. No. 6,012,029 (Cirino et al.); or other transmitted signals, see, for example, U.S. Pat. No. 6,501,378 (Knaven).

Another conventional method enables a portable electronic device to be located when the ambient light in the vicinity of the device is simply reduced below a predetermined level. See, for example U.S. Patent Application Publication No. 2003/0001738 (Chandar).

Unfortunately, some of the conventional methods described above are not reliable because they are subject to false alarms which cause the portable electronic device to emit an audible location signal prematurely. What is desired is a method and apparatus for locating an object that insures that an audible alert signal is emitted only when it is determined that the object is truly lost.

BRIEF SUMMARY OF THE INVENTION

The present invention is an apparatus and method for locating an object only when a specific predetermined command is received.

In one embodiment, an apparatus for locating an object includes an ambient light sensor circuit and an alarm circuit in communication with the ambient light sensor circuit. The ambient light sensor circuit detects the occurrence of a plurality of transitions between a first light level and a second light level. The ambient light sensor circuit determines if a time period between at least some of the transitions is less than a predetermined value. An alarm circuit in communication with the ambient light sensor circuit emits an alert signal if the time period is less than the predetermined value.

The predetermined value may be about 500 milliseconds. The apparatus may be fastened to the object or incorporated into the object. The alert signal may be audible.

In another embodiment, an apparatus for locating an object includes an ambient light sensor, a position sensor, and an alarm circuit in communication with the ambient light sensor and the position sensor. The ambient light sensor detects an ambient light level below a predetermined threshold. The position sensor detects when the object is not in a predetermined axial orientation. The alarm circuit emits an alert signal when the ambient light level is below the predetermined threshold and the object is not in the predetermined axial orientation. The alarm may emit the alert signal if the ambient light level is below the predetermined threshold for at least a predetermined time period and/or the object is not in a predetermined axial orientation for at least a predetermined time period. The predetermined time period may be about twenty seconds.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
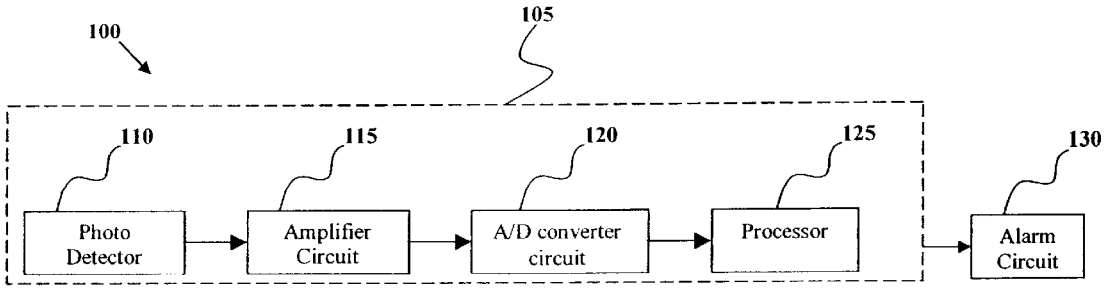
FIG. 1 shows a block diagram of an apparatus for locating an object by measuring a time period between at least some of a plurality of transitions between a first and second light level in accordance with one preferred embodiment of the present invention.

FIG. 1 is a block diagram schematic of an apparatus 100 for locating an object in accordance with one embodiment of the present invention. The apparatus 100 includes an ambient light sensor circuit 105. The ambient light sensor circuit 105 includes a photo detector 110, an amplifier circuit 115, an analog-to-digital (A/D) converter circuit 120 and a processor 125. The apparatus 100 also includes an alarm circuit 130 which is in communication with the ambient light sensor circuit 105.

Photo detector 110, comprised of a photodiode or photocell, in communication with a sense resistor (not shown), sends a signal to the amplifier circuit 115. An ambient light detection signal is outputted from the photo detector 110 to the amplifier circuit 115, the amplitude of the signal (e.g., voltage level signal) being dependent upon the intensity of surrounding ambient light sensed by the photo detector 110. Amplifier circuit 115 buffers the ambient light detection signal. The amplifier circuit 115 may include an automatic gain control (AGC) circuit for extending the useful linear range of operation. The magnitude of the buffered ambient light detection signal is converted to a digital value by the A/D converter circuit 120 and is inputted into the processor 125. Processor 125 may be a microcontroller or microprocessor. The alarm circuit 130 is in communication with the processor 125 in ambient light sensor circuit 105.

Ambient light sensor circuit 105 detects the occurrence of a plurality of transitions between a first light level and a second light level, and determines if a time period between at least some of the transitions is less than a predetermined value (e.g., about 500 milliseconds). If the time period is less than the predetermined value, the alarm circuit 130 emits an alert signal which may be an audible or visual signal.

A/D converter circuit 120 may typically be of 8-bit resolution. However, higher resolution may extend the useful range of light intensity over which apparatus 100 will operate. Resolution determination is a function of the sensitivity of photo detector 110 and the value of the sense resistor therein. A/D converter circuit 120 supplies a binary digital representation of the surrounding ambient light intensity to the processor 125 as one of the determining factors for activating the alarm circuit 130. Processor 125 may optionally include an internal A/D converter and thus negate the need for A/D converter circuit 125.

During operation of apparatus 100, software running on processor 125 periodically reads the digital value representation of the surrounding ambient light intensity from A/D converter circuit 120 and compares the current value to a previously stored value. If the absolute difference between the light intensity values is less than a predetermined minimum, no action is taken and the software waits for its next cycle of polling. If the difference between the light intensity values is greater than or equal to the predetermined minimum, then the time of occurrence of the current reading is compared to the time of occurrence of the previously stored value. If the difference between the time of occurrence of the two readings is greater than or equal to a predetermined value, a counter variable is cleared and the current light intensity value and the time of occurrence are stored, replacing the previous values. If the difference between the time of occurrence of the two readings is less than the predetermined value, then the counter variable is incremented. If the counter variable is less than a predetermined minimum, the current light intensity value and the time of occurrence are stored, replacing the previous values, and the software waits for its next cycle of polling. If the counter variable is greater than or equal to the predetermined value, processor 125 sends an enabling signal to alarm circuit 130 causing it to emit an alert signal. The counter variable is then cleared, the current light intensity value and the time of occurrence are stored, replacing the previous values, and the entire process repeated. For example, in an effort to locate an object to which apparatus 100 is fastened or incorporated into, a user can turn the lights on and off in a room in which the object is suspected of being located, causing the alarm circuit 130 to emit an alert signal which indicates the location of the object to the user.

In one alternative embodiment, the ambient light sensor circuit 105 may use a one-shot edge detector circuit (not shown), well known to those of ordinary skill in the art, rather than the amplifier circuit 115 and A/D converter circuit 120. The one-shot edge detector circuit may be comprised of a comparator or discrete transistors, and supporting resistors and capacitors, and may be configured to output a signal to processor 125 on a rising or falling edge, an indication of the surrounding ambient light brightening or dimming. During the operation of the ambient light sensor circuit 105, the comparison of light levels is performed by the one-shot edge detector circuit, rather than the processor 125. The processor 125 measures the time period of subsequent edges of the signal produced by the one-shot edge detector circuit. Furthermore, the processor 125 may be replaced with discrete logic gates configured to measure and count the subsequent edges of the signal.

In another alternative embodiment, the light sensor circuit 105 may use a voltage-controlled oscillator circuit (not shown), well known to those of ordinary skill in the art, rather than the amplifier circuit 115 and the A/D converter circuit 120. The voltage-controlled oscillator circuit may provide an output frequency which is an indication of the surrounding ambient light intensity. The processor 125 measures and stores the frequency of the signal produced by voltage-controlled oscillator circuit, and uses that value as an indication of the surrounding ambient light intensity.

Figure 2:
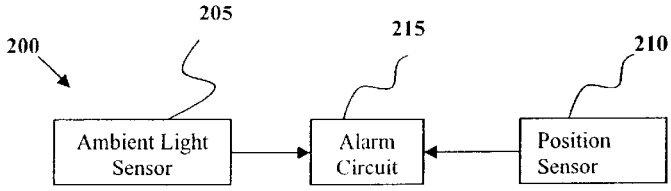
FIG. 2 shows a block diagram of an apparatus for locating an object by determining if the ambient light level is below a predetermined threshold and if the object is not in a predetermined axial orientation in accordance with an alternative embodiment of the present invention.

FIG. 2 is a block diagram schematic of an apparatus 200 for locating an object in accordance with yet another embodiment of the present invention. The apparatus 200 includes an ambient light sensor 205, a position sensor 210 and an alarm circuit 215. The alarm circuit 215 is in communication with the ambient light sensor 205 and the position sensor 210. The apparatus 200 may include a processor (not shown) used to selectively activate alarm circuit 215. The processor may be a microcontroller or a microprocessor. The value of ambient light intensity is polled on a periodic basis. If the value of ambient light intensity detected by the ambient light sensor 205 is below a predetermined threshold, a signal from position sensor circuit 210 is read to determine the orientation of the object. If it is determined that the object is in its usual or expected (predetermined) axial orientation, a lost object timer variable is set to zero until the next polling cycle. If it is determined that the object is in an unexpected or abnormal orientation (i.e., the object is not in its predetermined axial orientation), the lost object timer variable is incremented. If the value of the lost object timer variable is less than a predetermined minimum, no further action is taken until the next polling cycle. If the lost object timer variable is greater than or equal to the predetermined minimum, an enabling signal is sent to the alarm circuit 215 instructing it to emit an audible or visible alert signal. The lost object timer variable is then cleared, and the entire process is repeated.

For example, an object (e.g., a television remote control) to which apparatus 200 is fastened or incorporated into may be lost or stuck in the cushions of a sofa." As such, ambient light sensor 205 may detect that the surrounding ambient light is less than the predetermined threshold. Furthermore, position sensor 210 may sense that the object is not in an predetermined axial orientation. If, for a predetermined period of time, the surrounding ambient light is less than the predetermined threshold and the object is not in an predetermined axial orientation, an enabling signal is sent to alarm circuit 215 instructing it to emit an audible or visible alert signal.

The position sensor 210 outputs a binary output value, one state for an axial orientation angle (i.e., tilt) of greater than a predetermined angle, and the other state for an axial orientation angle of less than the predetermined angle. The position sensor 210 outputs a signal that is used as one of the determining factors for the output state that drives alarm circuit 215. Alarm circuit 215, comprised of an audible and/or visual output element, is activated accordingly.

Figure 3:
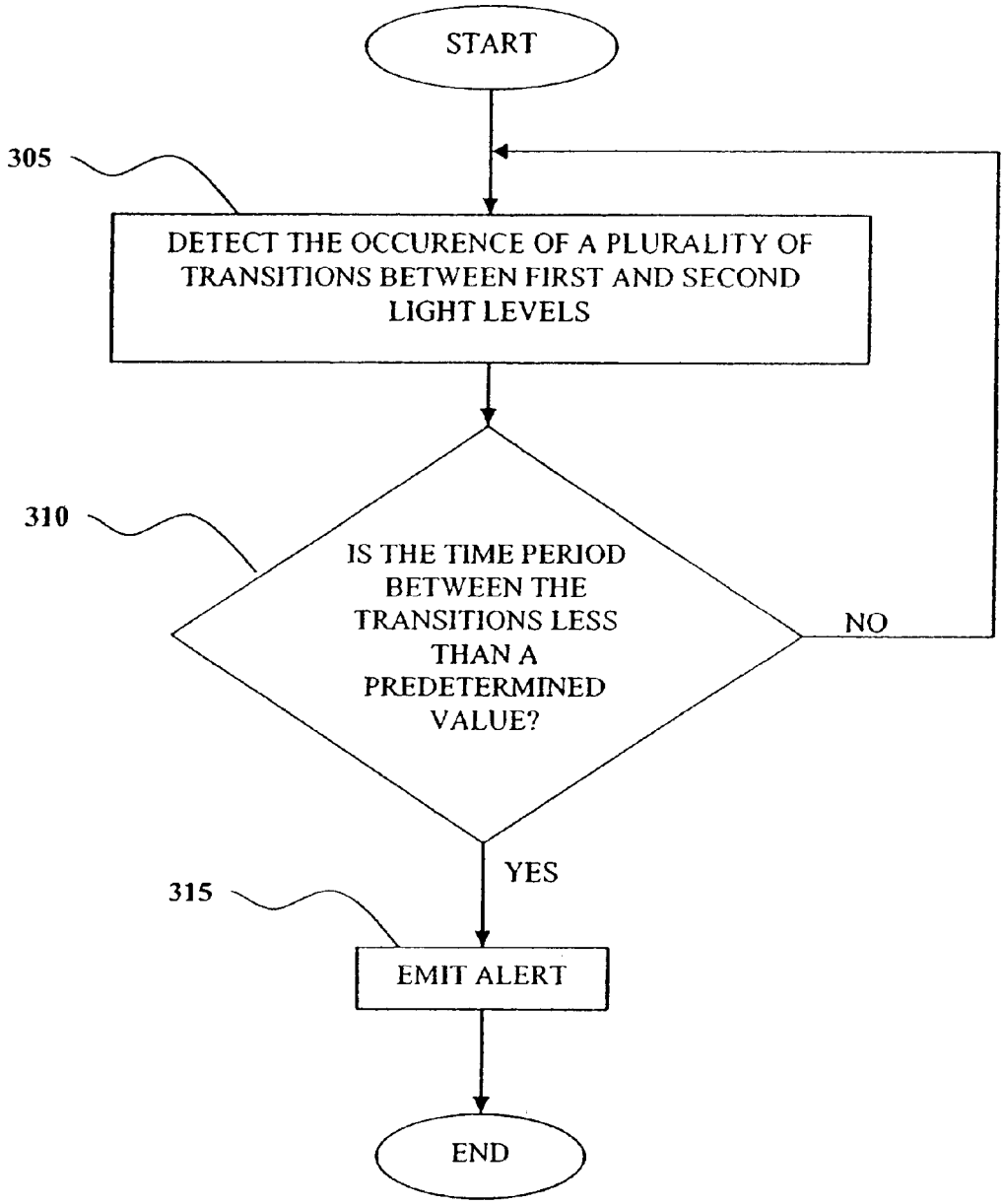
FIG. 3 is a flowchart including method steps implemented by the apparatus of FIG. 1.

FIG. 3 is a flow chart including method steps for locating an object implemented by the apparatus 100 (see FIG. 1). When the occurrence of a plurality of transitions between a first light level and a second light level is detected (step 305), and if a time period between at least some of the transitions is less than a predetermined value (step 310), an alert signal is emitted (step 315). The predetermined value may be about 500 milliseconds.

Figure 4:
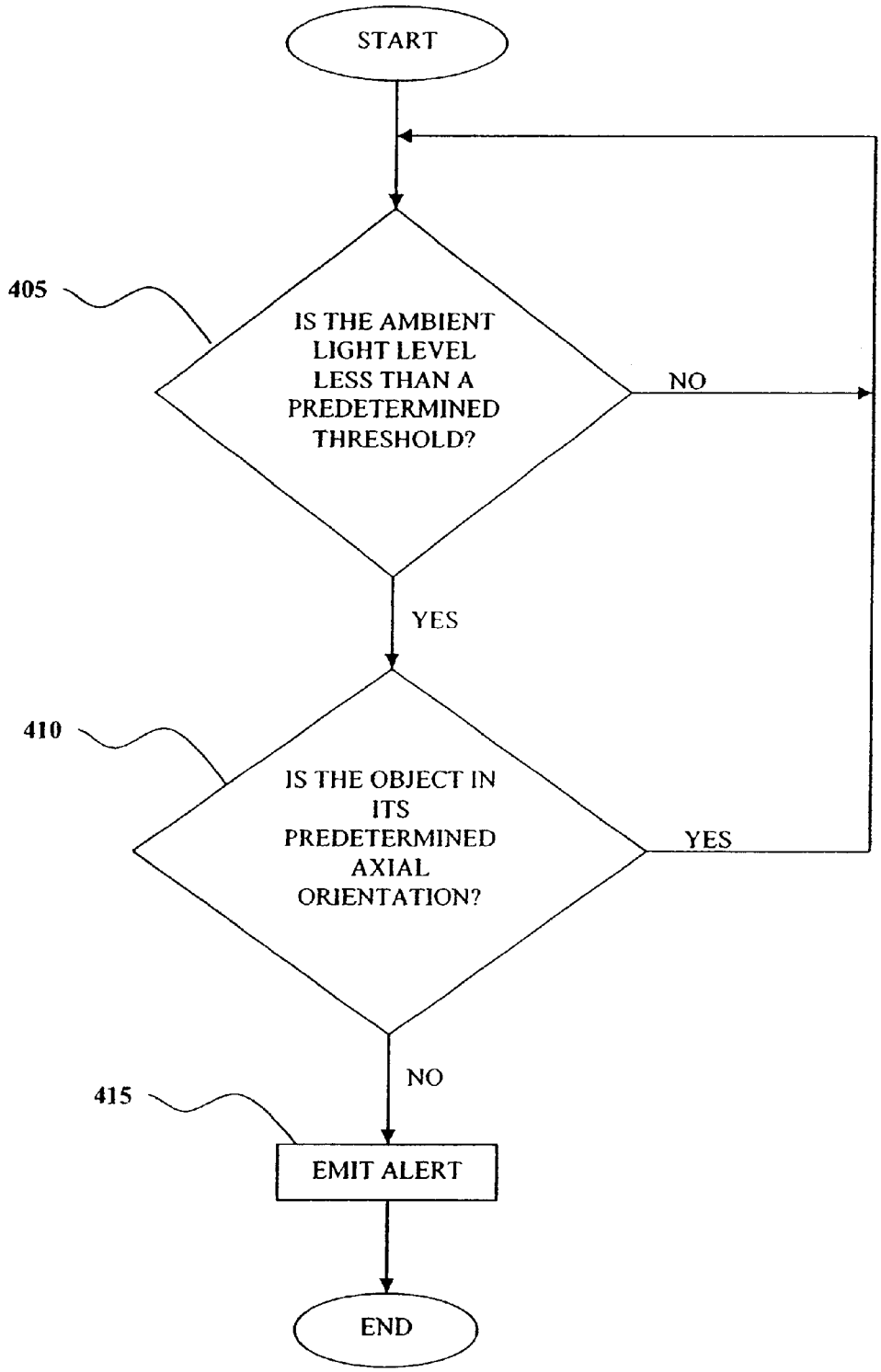
FIG. 4 is a flowchart including method steps implemented by the apparatus of FIG. 2.

FIG. 4 is a flow chart including method steps for locating an object implemented by the apparatus 200 (see FIG. 2). When it is detected that an ambient light level is below a predetermined threshold (step 405) and the object is not in a predetermined axial orientation (step 410), an alert signal is emitted (step 415). The alert signal may be emitted if the ambient light level is below the predetermined threshold for at least a predetermined time period, if the object is not in the predetermined axial orientation for at least a predetermined time period, or both. The predetermined time period may be about twenty seconds.

The present invention may be implemented with any combination of hardware and software. If implemented as a computer-implemented apparatus, the present invention is implemented using means for performing all of the steps and functions described above.

The present invention can be included in an article of manufacture (e.g., one or more computer program products) having, for instance, computer useable media. The media has embodied therein, for instance, computer readable program code means for providing and facilitating the mechanisms of the present invention. The article of manufacture can be included as part of a computer system or sold separately.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

I claim:

1. An apparatus for locating an object, the apparatus comprising:

(a) an ambient light sensor circuit which:

(i) detects the occurrence of a plurality of transitions between a first light level and a second light level, the transition resulting from switching lighting in the ambient environment between the first light level and the second light level, and (ii) determines if a time period between at least some of the transitions is less than a predetermined value; and (b) an alarm circuit in communication with the ambient light sensor circuit, the alarm circuit emitting an alert signal if the time period is less than the predetermined value.

2. The apparatus of claim 1 wherein the predetermined value is about 500 milliseconds.

3. The apparatus of claim 1 wherein the apparatus is fastened to the object.

4. The apparatus of claim 1 wherein the apparatus is incorporated into the object.

5. The apparatus of claim 1 wherein the alert signal is audible.

6. A method for locating an object, the method comprising:

(a) detecting the occurrence of a plurality of transitions between a first light level and a second light level the transition resulting from switching lighting in the ambient environment between the first light level and the second light level;

(b) determining if a time period between at least some of the transitions is less than a predetermined value; and (c) emitting an alert signal if the time period is less than the predetermined value.

7. The method of claim 6 wherein the predetermined value is about 500 milliseconds.

8. The method of claim 6 wherein the alert signal is audible.

9. An apparatus for locating an object, the apparatus comprising:

(a) an ambient light sensor which detects an ambient light level below a predetermined threshold;

(b) a position sensor which detects when the object is not in a predetermined axial orientation; and (c) an alarm circuit in communication with the ambient light sensor and the position sensor, wherein the alarm circuit emits an alert signal when the ambient light level is below the predetermined threshold and the object is not in the predetermined axial orientation wherein no alert signal is emitted if the object is in the predetermined axial orientation regardless of the ambient light level.

10. The apparatus of claim 9 wherein the alarm circuit emits an alert signal if the ambient light level is below the predetermined threshold for at least a predetermined time period.

11. The apparatus of claim 10 wherein the predetermined period of time is about twenty seconds.

12. The apparatus of claim 9 wherein the alarm circuit emits an alert signal if the object is not in a predetermined axial orientation for at least a predetermined time period.

13. The apparatus of claim 12 wherein the predetermined time period is about twenty seconds.

14. The apparatus of claim 9 wherein the alarm circuit emits an alert signal if (i) the ambient light level is below the predetermined threshold for at least a predetermined time period, and (ii) the object is not in a predetermined axial orientation for at least the predetermined time period.

15. The apparatus of claim 14 wherein the predetermined time period is about twenty seconds.

16. The apparatus of claim 9 wherein the apparatus is fastened to the object.

17. The apparatus of claim 9 wherein the apparatus is incorporated into the object.

18. The apparatus of claim 9 wherein the alert signal is audible.

19. A method for locating an object, the method comprising:

(a) detecting when an ambient light level is below a predetermined threshold;

(b) detecting when the object is not in a predetermined axial orientation; and (c) emitting an alert signal when the ambient light level is below the predetermined threshold and the object is not in the predetermined axial orientation wherein no alert signal is emitted if the object is in the predetermined axial orientation regardless of the ambient light level.

20. The method of claim 19 wherein the alert signal is emitted if the ambient light level is below the predetermined threshold for at least a predetermined time period.

21. The method of claim 20 wherein the predetermined time period is about twenty seconds.

22. The method of claim 19 wherein the alert signal is emitted if the object is not in the predetermined axial orientation for at least a predetermined time period.

23. The method of claim 22 wherein the predetermined time period is about twenty seconds.

24. The method of claim 19 wherein the alert signal is emitted if (i) the ambient light level is below the predetermined threshold for at least a predetermined time period, and (ii) the object is not in the predetermined axial orientation for at least the predetermined time period.

25. The method of claim 24 wherein the predetermined time period is about twenty seconds.

26. The method of claim 19 wherein the alert signal is audible.

* * * * *